United States Patent [19]

Powell et al.

[11] Patent Number: 4,658,870

[45] Date of Patent: Apr. 21, 1987

[54] DRIPLESS MULTI-VESSEL FLUID DISPENSER

[76] Inventors: Richard O. Powell, 9210 Chisolm, Austin, Tex. 78745; Bert L. Powell, Jr., 7919 El Dorado, Austin, Tex. 78737

[21] Appl. No.: 805,414

[22] Filed: Dec. 6, 1985

Related U.S. Application Data

[63] Continuation of Ser. No. 588,642, Mar. 12, 1984, abandoned.

[51] Int. Cl.[4] ..... B65B 3/06

[52] U.S. Cl. ..... 141/236; 141/238; 141/244; 141/367; 222/181; 222/488; 222/212

[58] Field of Search ..... 222/181, 212, 207, 215, 222/206, 488, 527, 529; 141/234, 236, 237, 238, 242, 244, 367, 368, 152, 84

[56] References Cited

U.S. PATENT DOCUMENTS

| | | | |
|---|---|---|---|
| 1,882,668 | 10/1932 | McCabe . | |
| 2,245,703 | 6/1941 | Mueller | 222/181 |
| 2,447,281 | 8/1948 | Schneir | 141/237 |
| 2,827,210 | 3/1958 | Ballard et al. . | |
| 2,831,610 | 4/1958 | Dennie | 222/527 |
| 3,196,909 | 7/1965 | Monk | 141/237 |
| 3,580,304 | 5/1971 | Chermack . | |
| 3,893,494 | 7/1975 | Whitney . | |

FOREIGN PATENT DOCUMENTS

| | | | |
|---|---|---|---|
| 2414323 | 9/1979 | France | 222/529 |

*Primary Examiner*—Robert J. Spar
*Assistant Examiner*—P. McCoy Smith
*Attorney, Agent, or Firm*—John Nevin Shaffer, Jr.; Thomas E. Sisson

[57] ABSTRACT

Apparatus for dispensing fluids to a plurality of receptacles simultaneously, equally, and without dripping. A distributing device is used that uses a major-minor channel configuration such that all major channels fill with fluid before the minor channels fill and all minor channels fill before water exits the outlet holes in the bottom of the distributor. A stand is included which supports the fluid to be distributed and which is designed to exactly center common communion trays beneath the distributor for filing. A stretchable transfer tube connects the fluid in the container with the distributor and, when pinched shut, causes fluid to be sucked back up the tube and which in conjunction with the pipette action of the outlet holes prevents drippage after filling. The distributor is round for filing communion cups but may be made in an infinite variety of shapes, all incorporating the major-minor channel configuration, such as rectangular for use in filling a plurality of restaurant glasses or watering trays of plants.

2 Claims, 7 Drawing Figures

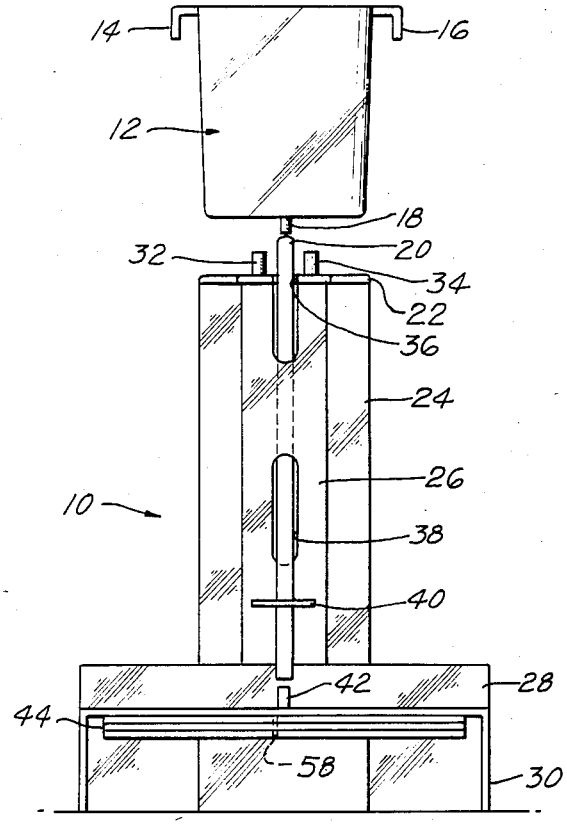
FIG. 1-A
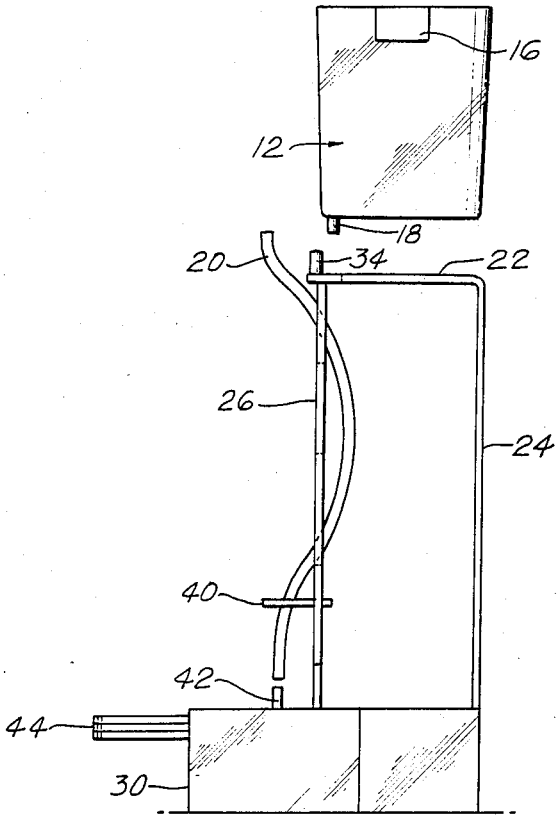
FIG. 1-B
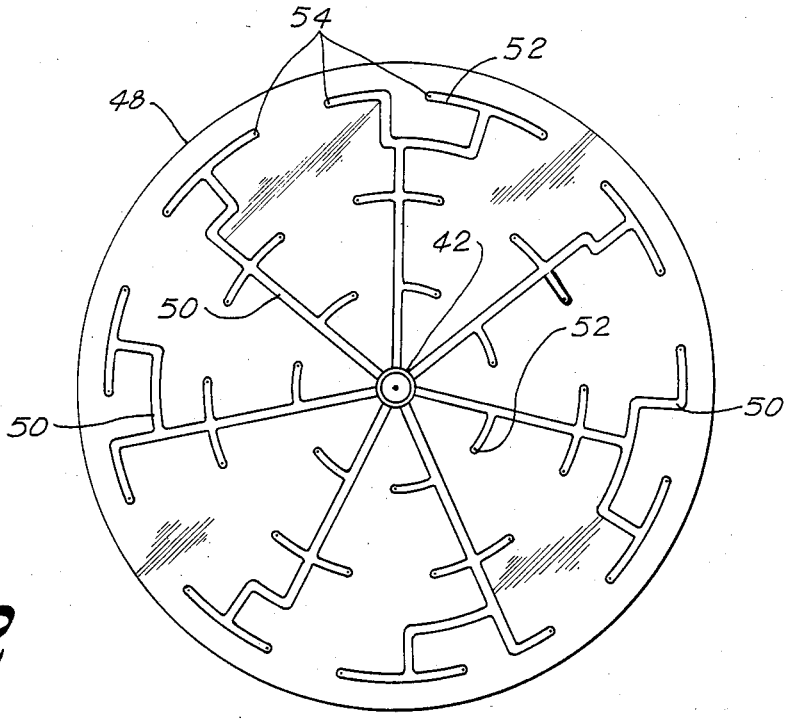
FIG. 2

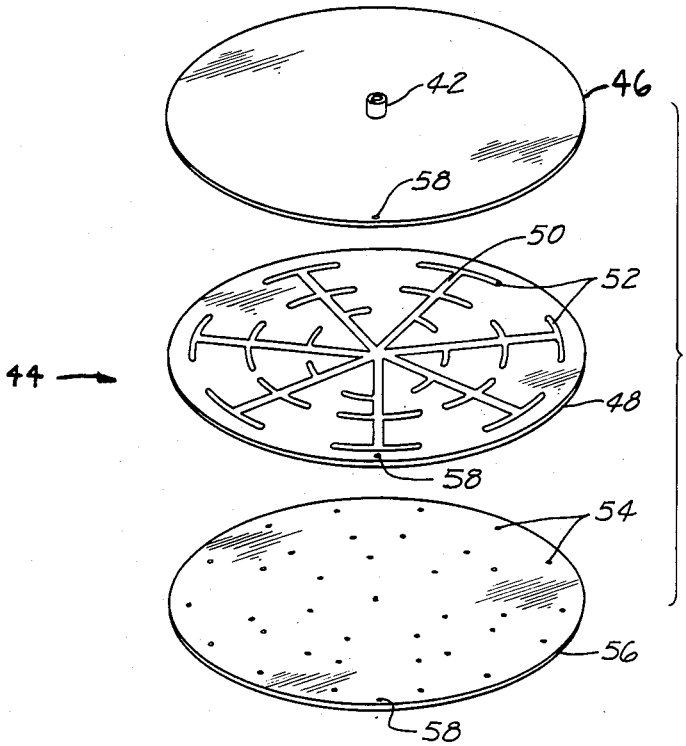
FIG. 3
FIG. 4
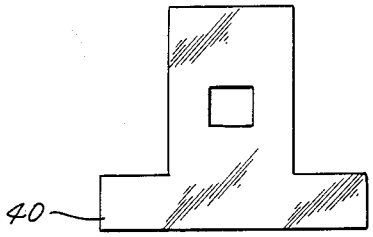
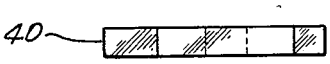
FIG. 5

DRIPLESS MULTI-VESSEL FLUID DISPENSER

BACKGROUND OF THE INVENTION

This application is a continuation of Ser. No. 588,642, filed 3/12/84, now abandoned.

1. Field of the Invention

This invention pertains to a device which is designed to dispense a variety of fluids into individual separate vessels for various uses. The gist of the invention is a clear plastic distributor through which fluid passes when introduced from above. The fluid is channeled from major/wide to minor/narrow channels and ultimately exits through openings or "outlet gates" in the bottom of the distributor. The combination of major and minor channels prevents non-uniform filling of containers placed below the distributor and, in fact, enables each vessel to be filled simultaneously and for filling to be stopped uniformly without dripping. In the case of utilization of the device for filling a plurality of communion glasses, the dripping is stopped by a no-drip cut-off means which interrupts the downward flow of the fluid by pressing the stretchable fluid transfer means and compressing the same against the side of the device. Since the fluid transfer means is of a rubbery stretchable substance, compressing it actually results in a upward suction on the end of the transfer tube and prevents any dripping whatsoever from occurring. When the major/-minor channel device is used for other than filling a plurality of communion glasses, an ordinary on-off valve is provided since some dripping, even though it is minimal, is not a concern when normal drinking glasses are filled or plants are watered, etc.

2. Description of Prior Art

While there are numerous types and designs of fluid dispensing devices, to the best of this inventor's knowledge, there has never been an invention such as this designed to uniformly and simultaneously dispense fluid to a plurality of communion glasses or other glasses through a distributing device which is simultaneous, equal, and does not drip. In this inventor's experience, every device that has been designed to attempt to deliver uniform and simultaneous amounts of fluid to communion vessels or other glasses, has failed in this attempt in that they lack uniformity in filling or the device dripped excessively once filling was completed. Additionally, previous attempts to develop fluid dispensers of this type have involved complicated and expensive machinery with the necessity of electric power, in some instances, required to drive the fluid through the dispenser. These methods have proved to be unpopular in that they are expensive and they do not deliver what is desired, that being simultaneous and equal filling of many vessels with no after dripping. Also, prior devices were difficult to handle, complicated and expensive to manufacture, hard to determine if they were dirty and, if dirty, difficult to disassemble and clean.

SUMMARY OF THE INVENTION

This invention consists of a molded plastic multi-vessel fluid dispenser. The fluid dispenser consists of three identifiable separate parts. These parts are the distributor, the stand, and the no-drip cut-off system. The heart of the system is the distributor which is made of a see-through polycarbonate, such as lexan. The distributor consists of three basic parts, those being the top plate, which is made of ⅛ inch lexan with a short piece of lexan tubing extending 2 inches through the center of the top and providing access to the distributor for the fluid. The second part of the distributor is the center gasket. This center gasket is positioned between the top and bottom plate and forms the major and minor channels of the device as disclosed in FIGS. 2 and 3 attached hereto, the minor channels are more narrow than the major channels and hold less volume of fluid than the major channels. As further described herein, the major channels will all fill before any of the minor channels will fill. Once all the minor channels are filled, all the "outlet gates" will simultaneously allow fluid to flow into vessels distributed below. The bottom plate contains the outlet gates or holes through which the fluid is dispensed. It is possible to combine the center and bottom plates into one.

The second portion of the device is a stand designed to simply and accurately center the tray or communion glasses under the distributor plate, to hold the container of whatever fluid is to be dispensed above the distributor plate and to provide a location for the placement of the no-drip cut-off valve. The stand is also made from a see-through polycarbonate and is approximately two feet in height.

The third part of the device is the no-drip cut-off valve which is a T-shaped device through which the fluid transfer means is passed. The fluid flow from the fluid container may be interrupted instantaneously by forcing the cut-off valve to a position wherein the transfer means is pinched. This pinching action causes the flow to stop and, as a result of the fact that the transfer means stretches, results in a sucking action which effectively eliminates any dripping whatsoever. The small size of the outlet gates in the distributor results in a "pipette action" which also actively resists dripping when flow is stopped.

It is anticipated that another practical use of the invention is for filling other vessels such as restaurant glasses. In that instance, the same major and minor channel relationship is employed. The result is that when fluid is introduced into the distributing device, fluid will fill the major channels before filling all the minor channels, after which fluid will simultaneously exit the outlet gates. A difference between the restaurant distributor for water or juice, for example, and the communion wine distributor is that the restaurant distributor will assume a rectangular shape to conform to the shape of common serving trays whereas the communion distributor is circular to conform to the shape of the communion holder. Additionally, the restaurant distributor will be of somewhat larger proportions and will lose some of the pipette action employed in the communion distributor and therefore will not totally provide the guaranteed no-drip distribution of the communion dispenser. Nevertheless, the restaurant distributor will employ the major-minor channel system which will enable water and juice glasses to be filled simultaneously and equally and limit dripping, once the glasses have been filled, to a minimum. The difference in the size of a communion glass and a restaurant glass removes the necessity for absolute no-drip performance from the distribution of fluid for restaurant glasses and allows the installation of a simple on-off valve in place of the T-shaped cut-off device and the flexible transfer means.

It is anticipated that the simultaneous filling action which characterizes both the communion distributor and the restaurant distributor could be utilized on many various applications in an infinite number of shapes and sizes. By way of an additional example, it could be utilized for watering plants in nurseries which are grouped together in large trays.

The characteristics that further describe this device are that no disassembly is necessary for cleaning as in other devices. The device may be cleaned simply by running water through it or some mild cleaning solution and then rinsing with water. Since the device is made of clear plastic, it is possible to tell at a glance whether it is clean and no disassembly is necessary if cleaning is needed. The device can be produced for less than $50.00 in 1984 prices. The device is simple and easily handled by one person.

The object of the invention is to provide a multi-vessel fluid dispensing device that insures that filling of vessels will commence and end simultaneously without dripping. When the circular distributor described above is utilized for dispensing of wine or communion juice, the size of the major and minor channels and the outlet gates is such that a pipette action results so that, when flow is stopped, all gates stop flowing simultaneously and no dripping occurs. This pipette action is supported and enhanced by use of the no-drip cut-off device with the stretchable transfer means which sucks back when closed off and stretched. When the major/minor channel device is used in rectangular shape for filling of restaurants glasses, the size of the channels has been somewhat enlarged and the size of the outlet gates have been somewhat enlarged to increase flow and as a result, some of the pipette action is lost. Nevertheless, the employment of the major-minor channel system allows restaurant glasses to be filled simultaneously and equally, and limits dripping, once the glasses have been filled, to a minimum.

BRIEF DESCRIPTION OF THE DRAWINGS

For a description of the construction and operation of the device of this invention, reference is made to the attached drawings and identical reference characters will be utilized to refer to identical or equivalent structures throughout the various views and the following detailed description.

FIGS. 1-A and 1-B are exploded views of the device.

FIG. 2 is a plan view of the center gasket designed for use with communion vessels.

FIG. 3 is an exploded view of the circular distributor composed of a top plate, a center gasket, and a bottom plate.

FIG. 4 is a plan view of the T-shaped no-drip cut-off means.

FIG. 5 is a front view of the T-shaped no-drip cut-off means.

DETAILED DESCRIPTION

Figure 3A:
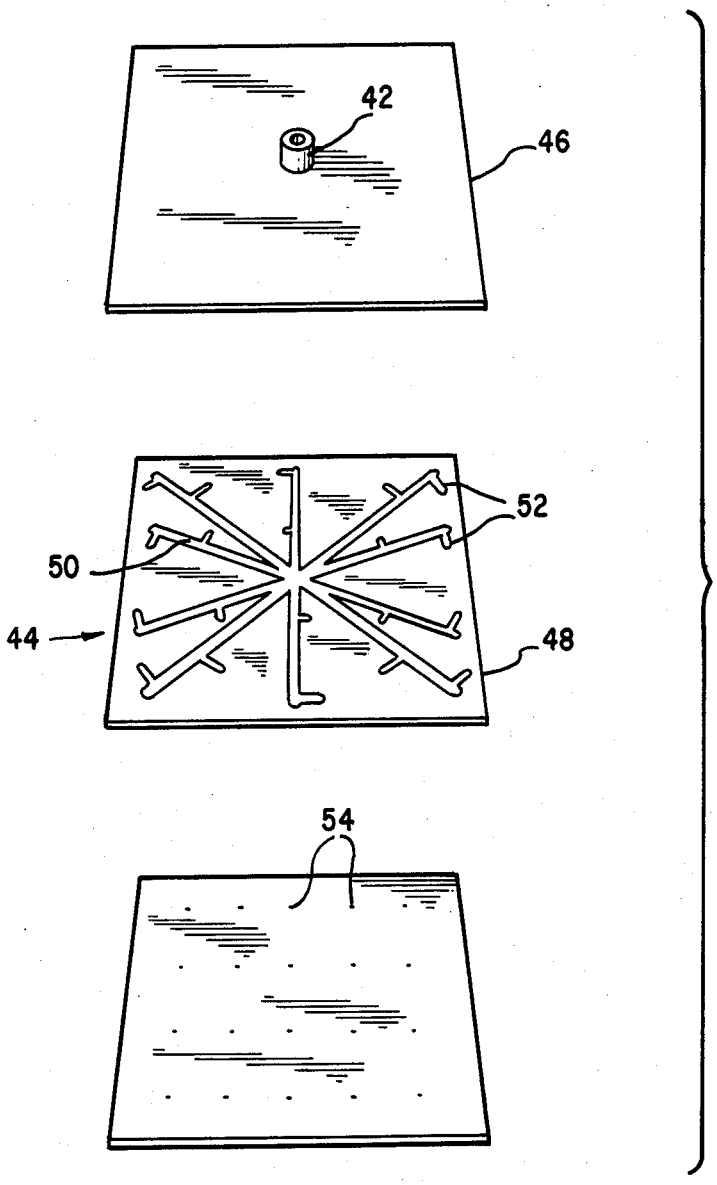
FIG. 3A is an exploded view of the rectangular distributor composed of a top plate, a center gasket, and a bottom plate.

Referring to the FIGS. 1-A and 1-B, 10 denotes the invention itself consisting of a fluid container 12 made of a clear polycarbonate substance, such as lexan, said container having been adapted with two oppositely positioned handholds 14 and 16 and a downwardly positioned dispensing tube 18 approximately one inch long through which fluid in fluid container 12 will exit. Connected to the dispensing tube means 18 is a transfer means 20 made of flexible tubing, such as surgical tubing, designed to connect with the dispensing tube means 18 at the bottom of fluid container 12 and provide a means of delivering the fluid downwardly. Fluid container 12 rests upon a platform 22 created by the right angle bend at the top of upright 24. Said upright is supported by brace 26 which supports said platform 22 from underneath and is itself supported by a stand cross brace 28 that provides rigidity to the foot 30 of the stand. The platform 22 has two oppositely attached polycarbonate restraining pegs 32 and 34 which act in conjunction with downwardly positioned dispensing tube means 18 to prevent the filled fluid container 12 from slipping from platform 22. Said downwardly positioned dispensing tube means 18 fits into groove 36 in platform 22 and helps lock fluid container 12 in position in conjunction with restraining pegs 32 and 34 and prevent sideway motion of said fluid container. The upward end of the transfer means 20 is attached over the downwardly positioned dispensing tube means 18 and said transfer means 20 then extends downwardly behind brace 26 and through an opening 38 in brace 26. Said transfer means 20 then comes forward of brace 26 and passes through the center of the no-drip cut-off valve 40 illustrated in FIGS. 4 and 5. When said no-drip cut-off valve 40 is in its outwardly extended position, the transfer means 20 is free and open and capable of passing fluid from fluid container 12 downwardly. However, when the no-drip cut-off valve 40 is pushed horizontally back towards upright 24, the transfer means 20 is compressed against brace 26 which results in the blockage of fluid from fluid container 12 and prevents said fluid from passing downward any further. The transfer means 20 then attaches to an upwardly pointing reception means 42 thereby completing the connection between fluid container 12 and the distributor 44.

In the illustrated embodiment shown in FIG. 3, distributor 44 is shown in an exploded view. Distributor 44 consists of a top plate 46 which contains upwardly pointing reception means 42. Top plate 46 is secured to stand cross brace 28 and does not move or rotate. The center of the distributor 44 is the center gasket 48 which contains major channels 50 and minor channels 52. When fluid leaves fluid container 12 and passes through downwardly positioned dispensing tube 18 and enters fluid transfer means 20, it will pass through upwardly pointing receiver means 42 and enter the major channels 50 of center gasket 48. Once all of said major channels 50 are filled, the minor channels 52 will commence filling. Once all of said minor channels 52 have been filled, fluid will then commence exiting from outlet gates 54 in bottom plate 56.

In the illustrated embodiment in FIG. 2, center gasket 48 is shown in plan view illustrating major channels 50 and minor channels 52 configured to distribute fluid to forty communion cups disposed beneath distributor 44. FIG. 3 shows a center gasket 48 designed with major channels 50 and minor channels 52 configured to distribute fluid to thirty-five communion cups disposed beneath distributor 44. It is clear that any number of cups may be served with this design with a simple modification of major and minor channel branches. In fact, fewer cups may be served simply by covering outlet gates 54 with tape.

In use, the device 10 enables a standard communion tray to be disposed beneath the fluid container 12 in an accurate position to receive fluid into each of the vessels contained in said tray by the simple means of pushing the tray underneath the distributor 44 up against the foot 30. Said foot is designed to accurately space the tray concentrically beneath distributor 44. A single alignment marker 58, a hole drilled through distributor 44, is all that is needed to complete the accurate location of communion glasses beneath distributor 44. Once the communion tray is located accurately, the no-drip cut-off valve 40 is pushed back towards the upright 24 closing off the transfer means 20. Fluid is then introduced into fluid container 12 and then the no-drip cut-off valve 40 is pulled outwardly away from upright 24 and fluid then completes its travel from fluid container 12 through transfer means 20 into the upwardly pointing receiver 42, passes into major channels 50 and then into minor channels 52 of center gasket 48 of distributor 44 and ultimately passes simultaneously through outlet gates 54 into glasses contained in a communion tray previously placed below said distributor 44. In approximately 3 to 5 seconds, the communion glasses will have been filled and when the no-drip cut-off valve 40 is pressed towards the upright 24, fluid is immediately prevented from passing through transfer means 20 and because said transfer means 20 is of a flexible nature said transfer means is stretched and actual upward suction is created on the outlet gates 54 in distributor 44 and that, in conjunction with the fact that the outlet gates are of such a size as to prevent dripping through pipette action, prevents any dripping whatsoever.

One preferred embodiment is described by a support frame made of clear plastic, such as lexan, with an upright piece $\frac{1}{4}$ inch by $3\frac{5}{8}$ inches by 22 inches, with a base piece $\frac{1}{2}$ inch by $2\frac{5}{8}$ inches by 24 inches and with a brace $\frac{1}{4}$ inch by $2\frac{1}{2}$ inches by 12 inches so that a standard communion glass tray fits directly underneath the outlet gates. And, further, where the flexible transfer means is made of surgical tubing and where the distributing device for use with communion glasses is made off two 10 inch circular clear plastic, such as lexan, disks 1/16 inch thick and one 10 inch disk $\frac{1}{8}$ thick, the $\frac{1}{8}$ inch disk being utilized to make the top plate of the distributing device, the top plate having a $\frac{5}{8}$ inch outside diameter and $\frac{3}{8}$ inch inside diameter piece of plastic 2 inches long fixed to the center of the top plate as an upwardly pointing reception means to which the end of the transfer means is attached. Further, the two 1/16 inch pieces of lexan being utilized to make the center gasket with major and minor channels and the bottom plate utilized to make the plurality of outlet gates located at the end of each minor channel may be glued together with an adhesive such as methylene chloride glue. Also, the device is provided with a hole in the front of the distributor with which alignment of communion trays is completed.

In addition to the illustrated embodiment shown in FIGS. 1-A, 1-B, 2, and 3, the distributor 44 may be configured so that it is rectangular in shape (as shown in FIG. 3A), as opposed to circular, in order that it may be used in conjunction with filling trays of restaurant glasses or watering trays of plants in a nursery, etc. Nevertheless, the same properties of the distributor device 44 are present, that is, an upwardly pointing receiver means 42, and major channels 50 and minor channels 52 in which fluid will fill all the major channels first and then the minor channels and then will exit through outlet gates distributed below the minor channels. Fluid will then fill the fluid glasses or other items distributed beneath the distributor and fluid will be stopped by use of a simple on-off valve. In this instance, however, due to the larger volume to be passed, outlet gates 54 will be slightly larger and will retain most of pipette action described above, but some drippage will occur. Nevertheless, the employment of the major-minor channel system ensures that filling will occur simultaneously and equally and limits drippage to a minimum.

Thus, according to this invention, a plurality of communion glasses may be filled when positioned below the device and when the distributor used is that designed for such purpose. These communion glasses will be simultaneously, uniformly and quickly filled without any after filling dripping occurring as described in the Figures. Not only does the invention provide a means to insure simultaneous, dripless filling of communion glasses but also provides for simultaneous, uniform filling of restaurant glasses or watering trays of plants when utilizing a larger distributor in rectangular shape. While such a distributor may drip somewhat, this problem is not as critical when filling restaurant glasses or watering plants and the major-minor channel system functions to limit even the small amount of dripping that may occur in that instance.

While the invention has been described in connection with the preferred embodiment, it is not intended to limit the invention to the particular forms set forth, but, on the contrary, it is intended to cover alternatives, modifications, and equivalents as may be included within the spirit and scope of the invention as defined by the appended claims.

What is claimed is:

1. An apparatus for uniformly and simultaneously delivering an equal volume of fluid to a plurality of receptacles comprising:

a means for directing said fluid to a removeable detachable, generally flat, distributor, said distributor further comprising:

a top plate having a single opening therethrough, said opening in fluid communication with said means for directing said fluid;

a center gasket of generally uniform thickness having a plurality of major and minor slots of the same thickness cut therethrough, said major slots being wider than said minor slots, said major slots branching from each other at only one junction, said junction dispositioned and aligned below said single opening in said top place, each of said major slots having a plurality of said minor slots branching therefrom, each of said minor slots branching at an origin from only one of said major slots, said minor slots further having a terminal end;

a bottom plate with a plurality of small verticle passageways therethrough, each of said passageways having an inlet end and an outlet end, said inlet end dispositioned and aligned below said terminal end of each of said minor slots in said center gasket;

said top plate sealingly affixed to said bottom plate with said center gasket disposed between and securely affixed to said top plate and said bottom plate; and said single opening in said top plate, said slots in said gasket, and said verticle passageways in said bottom plate defining a fluid flow path for said fluid to flow from said directing means out said outlet end of said verticle passageways to said receptacles.

2. The apparatus of claim 1 wherein said means for directing said fluid to said distributor further comprises:

a support frame a fluid contained mounted on said support frame, elevated above said distributor and having a downwardly positioned fluid dispensing tube in a base of said container;

a resilient tube attached to said downwardly positioned fluid tube and directing said fluid to said distributor; and a cut-off valve attached to said frame and having said resilient tube passing through an opening in said valve whereby when said valve is in a shut position said tube is pulled and stretched between said opening in said valve and said frame resulting in fluid suck-back in said distributor thereby eliminating dripping of said fluid from said verticle passageways.

* * * * *